US005931567A

United States Patent [19]

Salzmann et al.

[11] Patent Number: 5,931,567

[45] Date of Patent: Aug. 3, 1999

[54] LIGHT FITTING WITH AN IN PARTICULAR SMALL-VOLUME LAMP

[75] Inventors: Gerd Salzmann, Dornbirn, Austria; Helfried Schadauer, Lemgo, Germany

[73] Assignee: Zumtobel Staff GmbH, Dornbirn, Australia

[21] Appl. No.: 08/843,040

[22] Filed: Apr. 11, 1997

[30] Foreign Application Priority Data

Apr. 18, 1996 [DE] Germany ..... 196 15 388

[51] Int. Cl.[6] ..... F21V 7/22

[52] U.S. Cl. ..... 362/304; 362/307; 362/327

[58] Field of Search ..... 362/296, 297, 362/304, 305, 307, 308, 309, 327, 348, 347, 346

[56] References Cited

U.S. PATENT DOCUMENTS

| | | | |
|---|---|---|---|
| 1,199,071 | 9/1916 | Heckert | 362/304 |
| 1,596,161 | 8/1926 | Dorey | 362/309 |
| 1,614,121 | 1/1927 | Halvorson, Jr. | 362/304 |
| 1,652,416 | 12/1927 | Schepmoes | 362/327 |
| 1,751,111 | 3/1930 | Steele et al. | 362/348 |
| 1,947,344 | 2/1934 | Lang | 362/304 |
| 1,976,163 | 10/1934 | Exelmans | 362/327 |
| 2,418,195 | 4/1947 | Rolph | 362/327 |
| 2,673,288 | 3/1954 | Stevens et al. | 362/327 |
| 4,081,667 | 3/1978 | Lewin et al. | 362/296 |
| 5,014,174 | 5/1991 | Won et al. | 362/327 |

*Primary Examiner*—Alan Cariaso

*Attorney, Agent, or Firm*—Fitzpatrick, Cella, Harper & Scinto

[57] ABSTRACT

Light fitting (1) having an in particular small-volume lamp (2) and having a main reflector (5) which is preferably set up for the radiation of a narrow bundle of light, whereby in at least on part region of the lateral periphery of the main reflector (5) there is arranged an auxiliary reflector (31), whereby the main reflector (5) is of transparent material and is coated on the outside or on the inside with a reflection layer (23), whereby the auxiliary reflector (31) is arranged outwardly of the main reflector (5), and whereby in the region of the auxiliary reflector (31) no reflection layer (23) is provided on the main reflector (5) (window 34).

20 Claims, 5 Drawing Sheets

6
4
16
15
5
W2
26
21
17,22
23,24
2
30,31
19
4a
11
33
34
11
5
9
18
W
8
7
3
12,13,14
1
27
W1
32

6
4
16
15
W2
26
21
17,22
23,24
23a,30a,33
Y
2
19
4a
11
30,31
34
11
5
9
35
18
W
8
5
23
7
12,13,14
W3
1
27
W1
32
3

LIGHT FITTING WITH AN IN PARTICULAR SMALL-VOLUME LAMP

BACKGROUND OF THE INVENTION

1. Field of the Invention

This invention relates to a light fitting which my be used with a small volume lamp and which is capable of radiating a narrow ray bundle.

2. Description of the Related Art

There are light fittings which are so configured that they radiate light with relatively small spread or scattering. Such light fittings are therefore suitable for illuminating relatively small areas relatively brightly. Since such light fittings are in most cases arranged in a vertical position with radiation directed downwardly, they are generally designated in the language of this technical field as "downlights".

A downlight radiates the light primarily steeply downwardly, so that beyond an angle of at least 30°, with reference to the horizontal, no light leaves the light fitting, or hardly any light leaves the light fitting. By these means, for persons in the illuminated room, there is avoided direct dazzling by the generally very bright lamps.

If such a light fitting is mounted in the vicinity of wall, the upper part of the wall remains dark because of the anti-dazzle measures, whilst radiation takes place on to the lower part of the wall, or a corresponding region of the room is illuminated. In order to avoid this effect and to approximately evenly illuminate the whole wall or the whole height range, it has already been proposed to build into such a light fitting on the side opposite the wall or the above-mentioned region, an auxiliary reflector, namely a so-called wall flood reflector. With such an installation, two configurations are possible.

In a first configuration, illustrated in the accompanying FIG. 1, the auxiliary reflector B can be mounted inside the main reflector A of the light fitting C. Thereby, the free cross-section of the light outlet opening D is reduced, which on the one hand leads to a reduction of efficiency. On the other hand, the reduced free cross-section involves an appearance which differs from the normal appearance, which can lead to subjective disturbance of the impression of the room. That is, the appearance of the light fitting is made worse.

With a second configuration, illustrated in FIG. 2, the main reflector A is cut out in the region opposite the wall to be illuminated or the region to be illuminated, the auxiliary reflector B being mounted in the region of the cut-out E outside the main reflector A. Through the cut-out opening E therein, the main reflector is mechanically weakened. Further, there is thereby made necessary an additional manufacturing step, which leads to a significant increase in the manufacturing effort.

SUMMARY OF THE INVENTION

The object of the invention is to so configure a light fitting of the kind concerned that at least one lateral partial region of the surroundings of the light fitting can be illuminated without loss of stability.

This object is achieved by a main reflector which is configured to radiate light through a light exit point and which is coated with a reflection layer except in one area in a lateral portion of its periphery, and an auxiliary reflector located laterally opposite that one area to radiate light coming to it through the one area.

With the configuration in accordance with the invention as described above, no cut-out is needed in the main reflector in the region of the auxiliary reflector. The irradiation of the auxiliary reflector is effected through the material of the main reflector. By these means, the manufacturing effort is significantly reduced and further the main reflector is not weakened.

Further, the invention has the object of so configuring a light fitting of the kind concerned that a simple and economically manufacturable construction is attained.

This object is achieved by means of a light fitting which comprises a lamp, a main reflector surrounding the lamp and arranged to cause a narrow light bundle from the lamp to be radiated from the main reflector. The main reflector has a base body made of transparent material which is coated on a surface thereof with a reflection layer; and an outer side of the base body is not parallel to a corresponding inner side thereof. Also, the inside of the base body is flat and the outside thereof has a light scattering structure.

With the configuration in accordance with the invention according to claim 10, the reflection layer is selectively arranged on the outside or on the inside of the main reflector. This is particularly advantageous when the transparent base body has a light scattering structure on the outside, e.g. is facetted. If the reflection layer is now applied on the outside of the main reflector, this scattering structure comes into effect. In contrast, if the reflection layer is applied to the smooth inside of the main reflector there is thus provided a simple reflector with smooth reflection layer. The scattering structure is in this case without effect, but in any event there can be realized, with a single mold for the transparent base body, two types of reflector (smooth or structured).

The reflection layer can be applied in simple and economical manner, whereby a good quality can be attained.

The subclaims contain features which improve the directed illumination of at least one lateral region, lead to simple, small and economically manufacturable constructions, and, further, improve the reflection.

BRIEF DESCRIPTION OF THE DRAWINGS

Below, the invention and further advantages which can be achieved thereby will be explained in more detail with reference to preferred exemplary embodiments and to simplified drawings, which show.

DETAILED DESCRIPTION OF THE PREFERRED EMBODIMENTS

Figure 3:
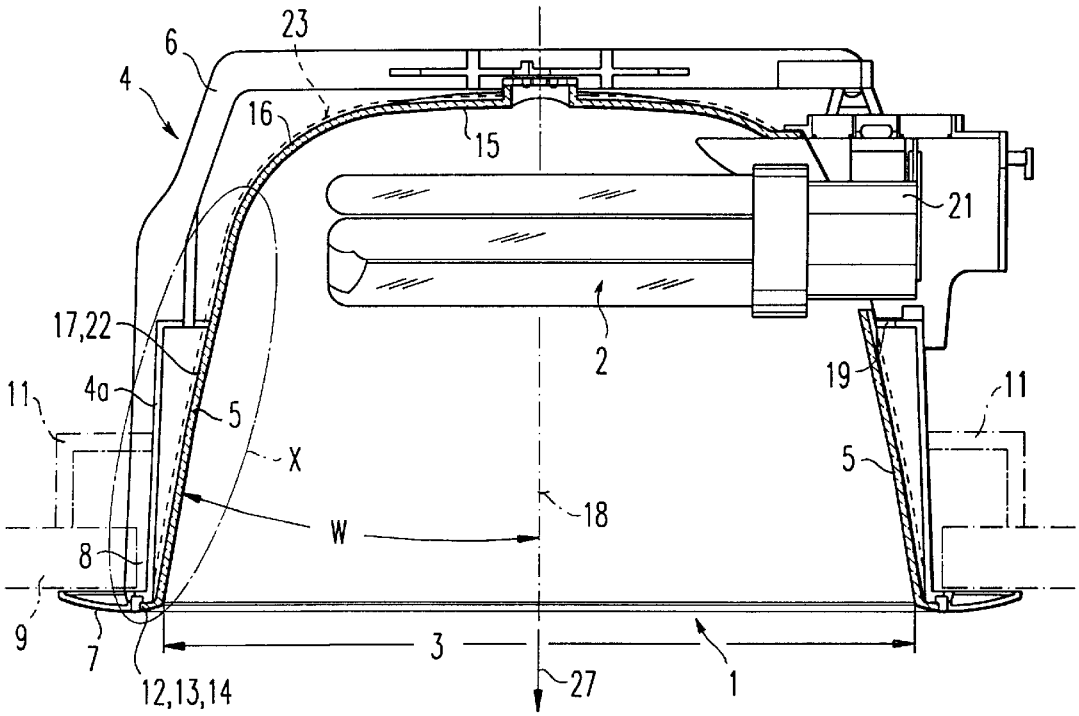
FIG. 3 a light fitting in accordance with the invention, in vertical section.

The light fitting 1 illustrated in the Figures is such a light fitting having a preferably small-volume lamp 2, e.g. a high pressure discharge lamp, a compact fluorescent lamp, a halogen lamp or the like. The cross-sectional size of the light outlet opening 3 of the light fitting 1 is relatively small, e.g. smaller than 250 mm in its largest cross-sectional dimension. The form of the light outlet opening 3 may be round or quadratic or elongate, e.g. rectangular or oval. A housing 4 and/or a main reflector 5 of the light fitting 1 may also be of corresponding cross-sectional form. In the present configuration, the light fitting 1 is structured as a build-in light fitting. The housing may be formed of individual frame pieces 6, which if appropriate bridge over the main reflector 5 in an arc-shape and hold a cover 7 present with the configuration concerned, which covers over the edge of an installation opening 8 in a ceiling 9, illustrated in FIG. 3, on the underside. With the present configuration there is provided in the lower region of the light fitting 1 a ring-shaped partial housing 4*a,* closed in the peripheral direction, at which the main reflector 5 may be mounted, and which is bridged over by at least one frame piece 6. On the housing or on the frame piece 6, mounting elements 11—illustrated in outline—for the light fitting 1 may be arranged which are supported on the installation opening edge of the ceiling 9. The cover 7 may be of individual frame parts or may be in one piece in the peripheral direction. Thereby, it, or its parts, can be formed in one piece with the housing 4 or the associated frame pieces 6, or may be attached to these parts.

Preferably, the main reflector 5 has at its lower edge a flange 12 projecting outwardly, which is received—at least partly sunken in—in a ring recess 13 in the cover frame and in particular is arranged so far sunk in that the forward or underside of the flange 12 is approximately at the level of the forward or underside of the cover frame. Thereby, the flange 12 can abut against a shoulder surface 14 forming the base of the ring recess 13.

The main reflector 5 has a dome-shape cross-sectional form, it being preferably formed in one piece. In the first region, the cross-sectional form of the main reflector 5 is formed to be flat or conical or in the shape of a section of a sphere, inclined radially outwardly. This first wall 15 is adjoined below by a rounding 16 which makes transition into a divergent side wall 17, which may be conically shaped or in the shape of an annular zone of a sphere. The angle W enclosed by the side wall 17 with the vertical middle axis 18 is relatively acute and is about 5 to 15°, in particular about 10°. That is, the side wall 17 is relatively steeply arranged.

The lamp 2 extends through an introduction opening 19 in the upper region of the reflector 5 and is mounted in this position by means of a suitable mounting 21, which may be attached to the housing 4 or to an associated frame piece 6. In the present configuration, the introduction opening 19 and the mounting 21 are arranged in the upper side region of the lamp 1.

Figure 1:
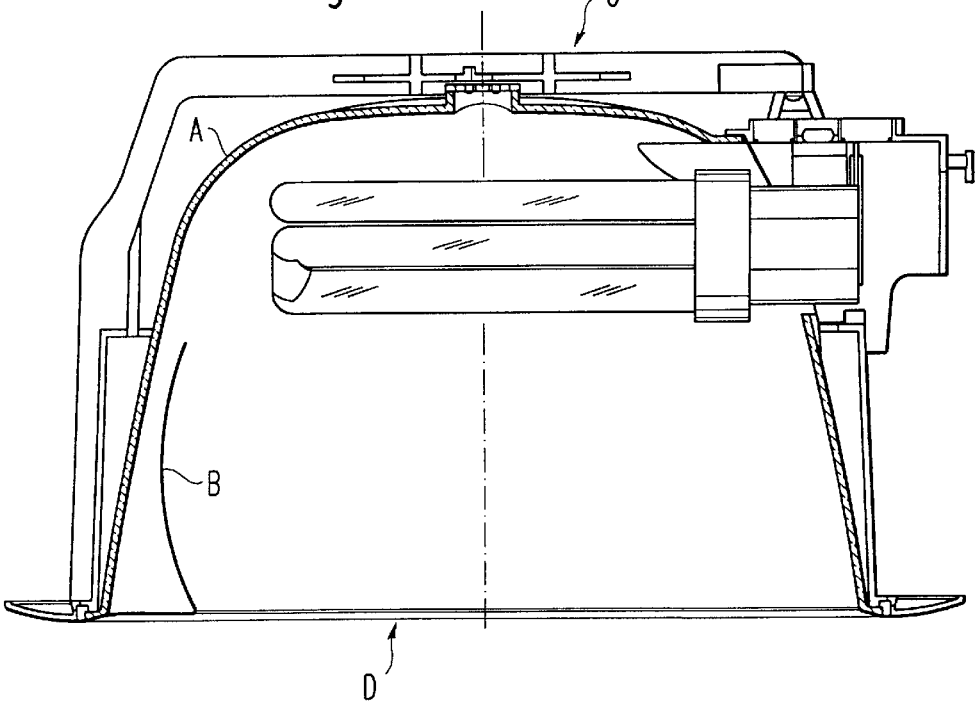
FIG. 1, a light fitting in accordance with the prior art in a vertical section.
Figure 2:
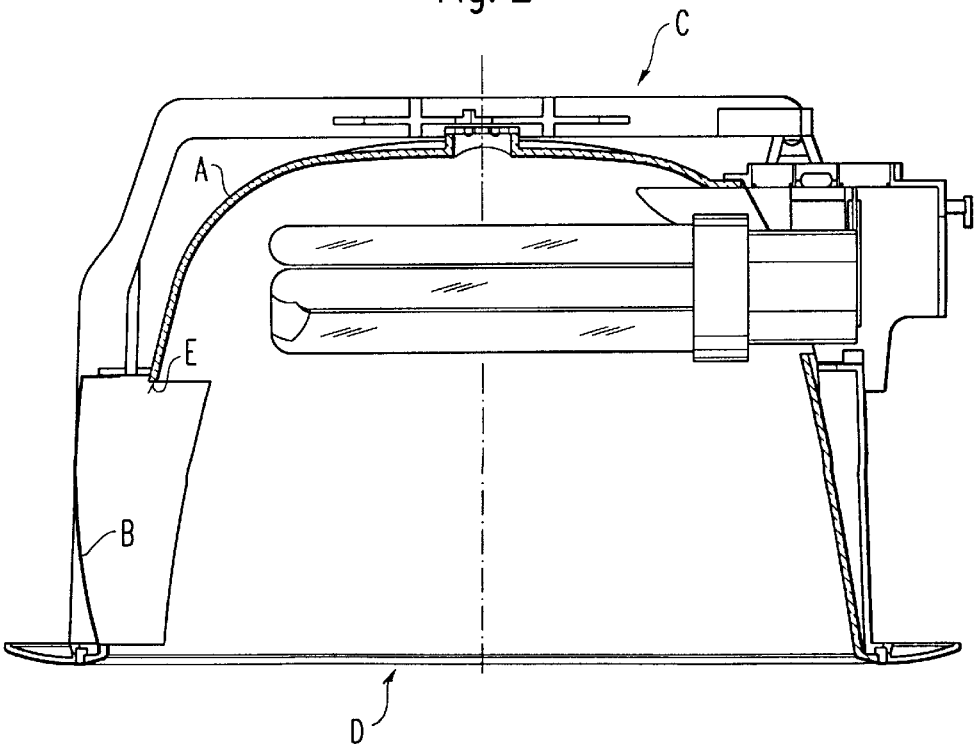
FIG. 2, another light fitting in accordance with the prior art and in a vertical section.

The main reflector is mounted in its first region on the housing 4 or on an associated frame piece 6 by means of suitable mounting means, e.g. clamps or screws. The base body of the main reflector 5 is of a transparent material such as glass or plastics, whereby the thickness of the peripheral wall 22 may be uniform as shown in FIG. 1. On the outside, the peripheral wall 22 is coated with a reflection layer 23 which forms a reflection surface 24 located on the outside of the main reflector 5, at which the light rays 25 coming from the lamp 2 are reflected. As can be understood in particular from FIG. 4, the light rays 25 are, upon penetration of the inner surface 26, initially refracted towards the side away from the direction of light propagation 27 and upon exiting the inner surface 26 are refracted towards the direction of propagation 27. Depending upon the angle of incidence relative to the inner surface 26 and the reflection surface 24 there are provided, from the illustration in FIG. 4, different directions of light rays.

Figure 4:
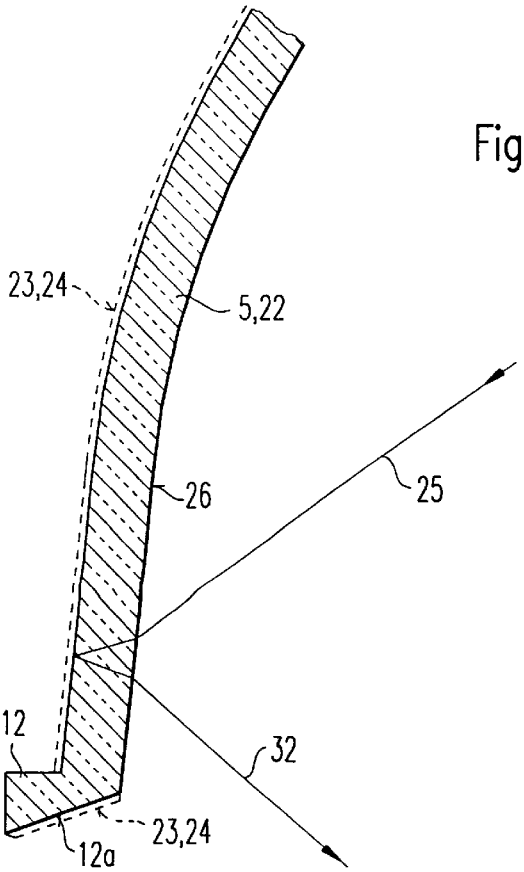
FIG. 4 the detail identified with X in FIG. 3, in a representation to an enlarged scale.

As can be seen from FIG. 4, the lower flange surface 12*a,* which is preferably formed upwardly conically convergently shaped, is covered with the reflection layer 23.

With the configuration according to FIG. 5, in which the same or similar parts are provided with the same reference signs, there is associated with the light fitting an auxiliary reflector 31 which is arranged in the lower region of the main reflector 5 or adjoins this from below and which can extend over the entire periphery or over only a part region of the periphery.

It is the purpose of such an auxiliary reflector 31 to so alter the relatively steeply radiating light fitting 1 that at least on at least one part region there is possible also a lateral radiation and illumination of a side wall in the room, or of the lateral region of the room. This additional and lateral direction of propagation is indicated by 32.

Figure 5:
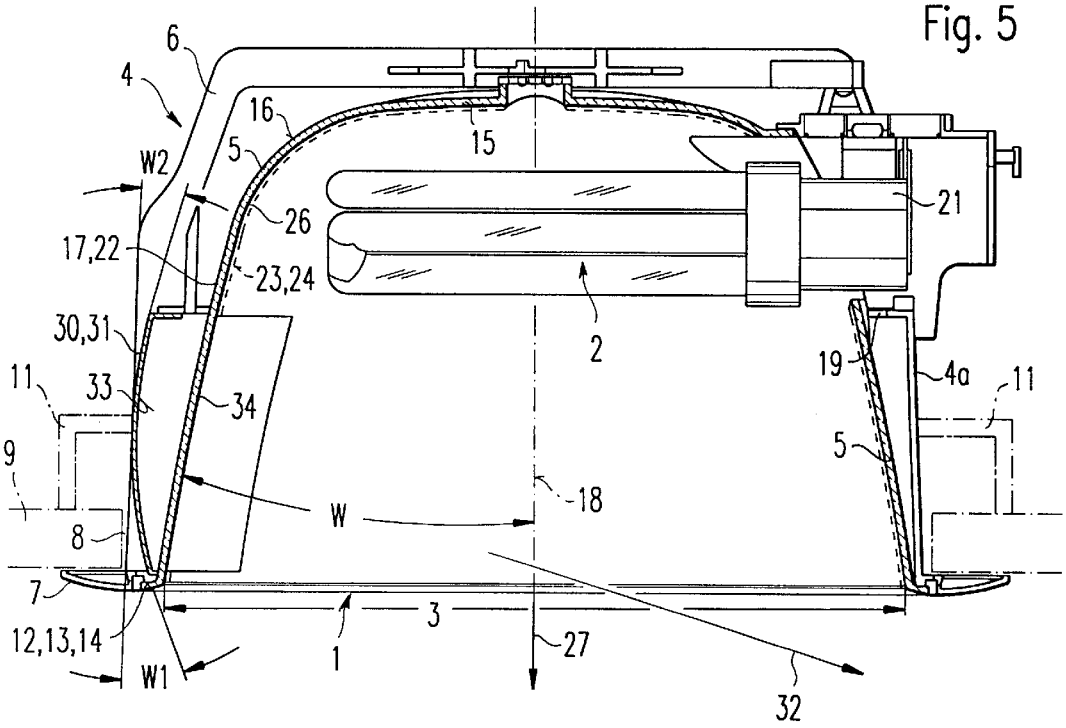
FIG. 5 a light fitting in accordance with the invention, in vertical section, in a modified configuration.

With the configuration according to FIG. 5, the auxiliary reflector 31 is arranged outwardly of the main reflector 5 whereby it has a outward spacing from the latter. The auxiliary reflector 31 is, towards the inward side, concave in the vertical, in particularly roundedly concave and is in the horizontal preferably adapted approximately to the peripheral form of the main reflector 5. As can be seen from FIG. 5, the upper and the lower regions of the reflection surface 33—inwardly arranged—of the auxiliary reflector 31 include angles W1, W2 with the vertical, which are approximately equal. By these means there is provided a favourable resulting lateral direction of propagation 32 which extends below the opposite lower edge of the auxiliary reflector 5.

With the configuration according to FIG. 5, the reflection layer 23 may be arranged on the outside or, preferably, on the inside 26 of the main reflector 5.

In the region of the auxiliary reflector 31 there is no reflection layer 23 on the main reflector 5. The thus-formed window 34 is, in its dimensions, approximately the same as or larger than the corresponding dimensions of the auxiliary reflector 31, so that a necessary amount of light rays pass through the peripheral wall 22 of the main reflector 5—which is transparent in the region of the window 34—, impinge on the auxiliary reflector 31 and are reflected at its reflection surface 33 in the direction of propagation 32.

From FIG. 5 it can clearly be seen that the reflection surfaces 24, 33, at least in the lower to middle region of the auxiliary reflector 31, diverge upwardly with regard to the middle axis 18.

The window 34 can be provided in a simple manner, e.g. by covering the inner and/or outer surface of the main reflector 5 upon its coating—outside or inside—with the reflection layer 23. This reflection layer is preferably of a metallic material. The reflection layer 23 can be applied by evaporating aluminium onto the main reflector 5, or by chromizing.

For the coating, there are well suited also per se known vacuum coating processes with evaporation, galvanic coating processes and chemical spraying processes for metallizing materials.

Figure 6:
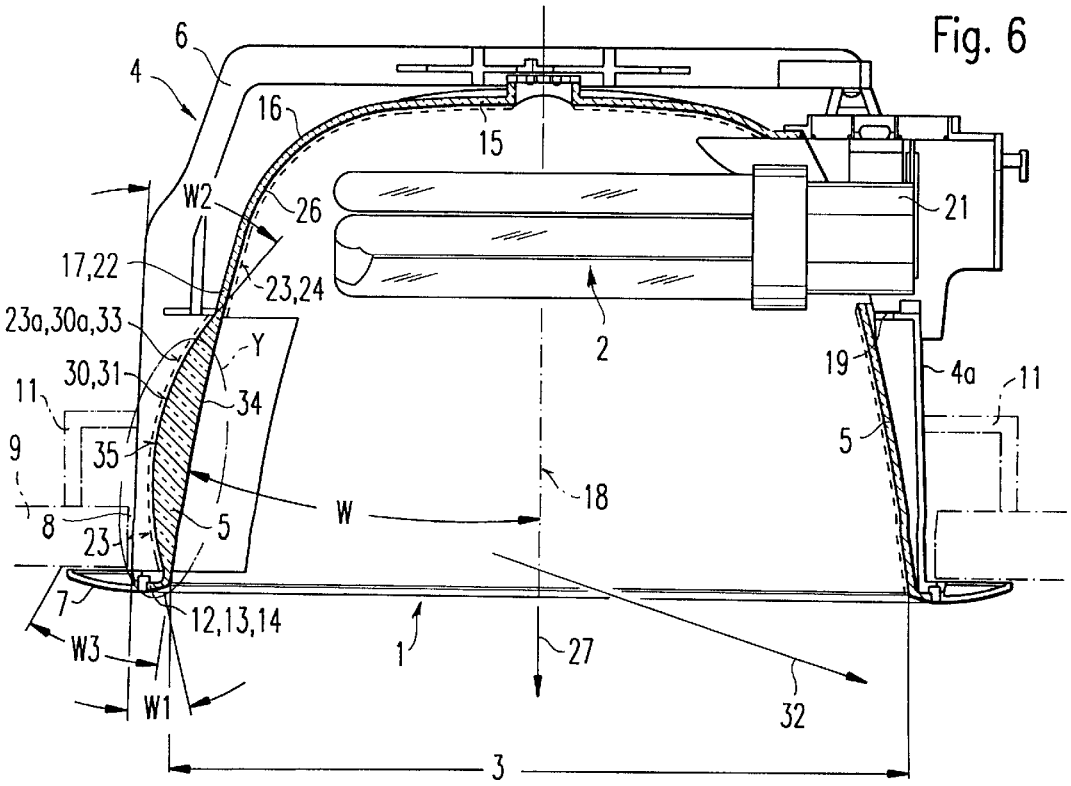
FIG. 6 a light fitting in accordance with the invention, in vertical section, in a further modified configuration.

With the configuration in accordance with FIG. 6, in which the same or similar parts are provided with the same reference signs, in contrast to the above-described configuration, the auxiliary reflector 31 is not arranged at an outward spacing from the main reflector 5, but is arranged directly on the outside of the main reflector 5, whereby the outside is formed outwardly to be convex in the vertical. This auxiliary reflector 31 is thus arranged in one piece on the main reflector 5. The reflection surface 33 is formed by means of a reflection layer 23*a*, on the outside, applied in the region of the window 34 and in the region of the outward formed part 35. With this configuration, the auxiliary reflector 31 is thus formed by means of a transparent thickening 30 or an outward transparent material adjoint piece on the main reflector 5. Also with this configuration, the reflection surface 24 can be formed by means of an outside, or preferably inside, coating of the main reflector with a reflection layer 23. In horizontal cross-section, the outer surface 30*a* of the thickening 30 or of the material adjoint piece, can extend parallel to the straight or curved peripheral wall 22. Thereby, the ends of the thickening 30 facing in the peripheral direction may be blunt, e.g. cornered or equally, rounded. It is also advantageous, both with a straight and with curved peripheral wall 22 to form the outer surface 30*a* convexly curved or with a more strongly convex curvature than the curvature of the peripheral wall 22, whereby there is provided a lens-like cross-sectional form for the thickening 30.

With the configuration according to FIG. 6, the reflection surface 33 encloses in its upper region a downwardly open acute angle W3 with the peripheral wall 22 of the main reflector 5. These are only exemplary advantageous configurations. Within the scope of the invention it is naturally possible to realize the arrangement and shape of the configuration in accordance with FIG. 5 in the configuration according to FIG. 6, and to realize in the configuration according to FIG. 5 the arrangement and shape in accordance with FIG. 6.

Figure 8:
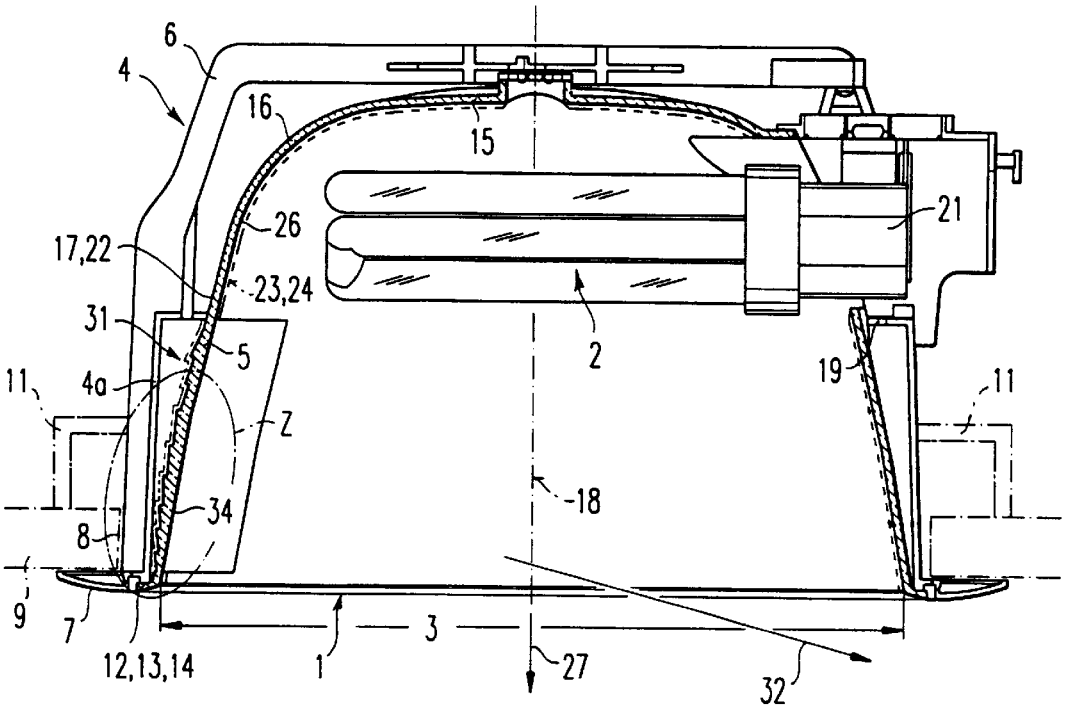
FIG. 8 a light fitting in accordance with the invention, in vertical section, in a further modified configuration.
Figure 7:
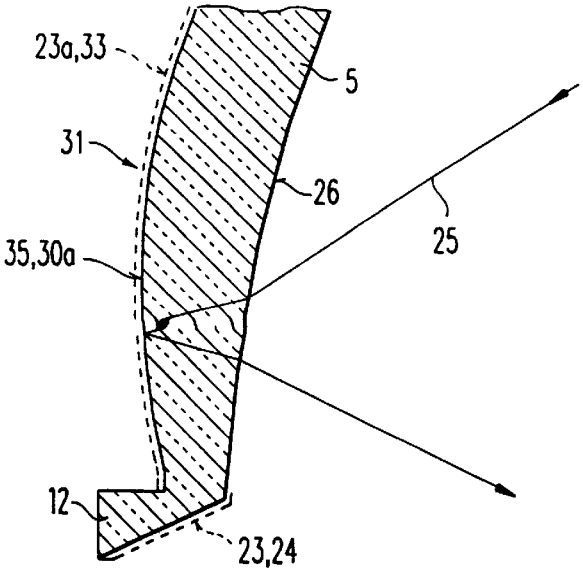
FIG. 7 the detail Y in FIG. 6, in a representation to an enlarged scale.
Figure 9:
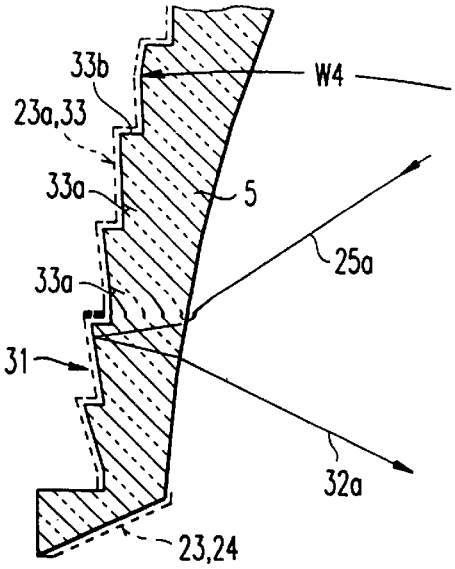
FIG. 9 the detail Z in FIG. 8, in a representation to a larger scale.

The configuration according to FIGS. 8 and 9 differs from the configuration according to FIGS. 6 and 7 in that the reflection surface 33 is divided into reflection surface strips 33*a* lying one above another, which with regard to a resulting direction of radiation 27 from the lamp 2 are arranged at such an angle W4 with regard to the vertical longitudinal middle axis 18 that—in each case taking into consideration the light refraction angle—the respective components of propagation 32 are directed beneath the opposite edge region of the main reflector 5. Between the consecutive reflection surface strips 33*a* there are arranged, transversely of those strips, step surfaces 33*b* which provide a step-shaped outer surface of the auxiliary reflector 31. At least the reflection surface strips 33*a* and preferably also the step surfaces 33*b* are coated with a reflection layer 23, so that the reflection is ensured in correspondence to the components of the propagation direction 32. With this configuration also, the reflection layer 23 may be arranged outwardly of the window 34 on the outside of the main reflector, or preferably on the inside 26 of the main reflector 5.

Figure 10:
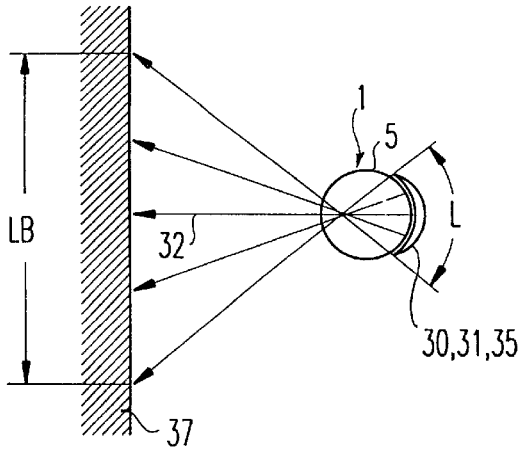
FIGS. 10 to 12 particular configurations and mounting positions of a light fitting in accordance with the invention.

The position or positions of one or more auxiliary reflectors 31 is or are determined in accordance with the needs of the lateral illumination. When, in accordance with FIG. 10, a lateral irradiation only to one side of the light fitting 1 is desired, e.g. for directed illumination of one wall 37 or one lateral region of the room, there is needed only one auxiliary reflector 31 at the opposite side of the light fitting 1 or of the main reflector 5, whereby the length L of the auxiliary reflector 31—considered in the peripheral direction—is to be such, e.g. about 90°, that the components of propagation reflected from its end regions approximately bound the lateral region LB to be illuminated.

Figure 11:
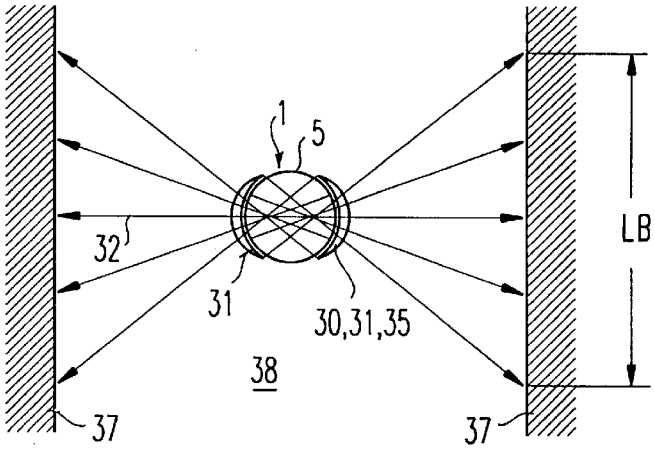

When, in accordance with FIG. 11, two mutually oppositely lying walls 37 are to be laterally illuminated, two auxiliary reflectors 31 are to correspondingly arranged opposite to one another.

Figure 12:
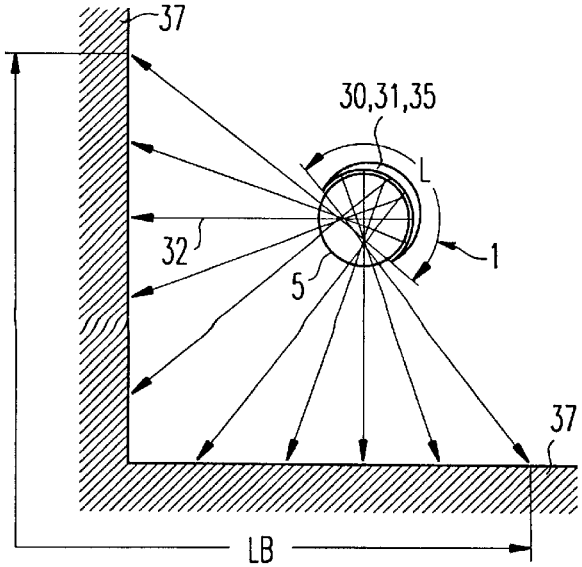

When, in accordance with FIG. 12, a corner, formed by two walls 37, or a corresponding region of a room is to be laterally illuminated, an auxiliary reflector 31 is to be arranged at the side of the light fitting opposite to the corner. Depending upon the size of the region LB to be illuminated, here also there may be provided an auxiliary reflector 31 of a length L according to FIG. 10 or 11 or of a length extending over an angle range of approximately 180°.

With all above-described exemplary embodiments, because of the steep illumination of the light fitting 1 constituting a downlight, in an angle of view in or transverse to the auxiliary propagation direction 32 the light fitting is screened. This is, for example in the case of illumination of a corridor 38 between the walls 37 in accordance with FIG. 11, of significance and advantage.

With all above-described exemplary embodiments it is possible and advantageous to provide a structure on the reflection surface 24, 33 of the main reflector 5 and/or of the auxiliary reflector 31 which brings about a light scattering in a small angular range and thus a reduction of the subjective dazzling and/or improves the aesthetic appearance of the light fitting. Such a structure may be, e.g., a per se known facetted surface. With the above-described configurations of the main reflector 5 and of the auxiliary reflector 31 this structure may be provided on the main reflector 5 at its inner or outer side, whereby with regard to the auxiliary reflector 31 this structure may be arranged also in the region of the window 34 on the inside or on the outside.

We claim:

1. A light fitting comprising:

a lamp;

a main reflector having a lateral periphery which extends around a main axis and which contains the lamp;

said main reflector being configured and arranged to radiate a narrow ray bundle in a given direction of propagation through a light exit point;

said main reflector being made of a transparent material and being coated on at least one surface thereof with a reflection layer except in at least one partial area of said lateral periphery where there is no reflection layer; and an auxiliary reflector arranged at said one partial area of said main reflector where there is no reflection layer;

said auxiliary reflector being configured and positioned to receive incident light from said lamp which passes through said partial area and to redirect such incident light back through said partial area so that it radiates in a different direction from said given direction through said exit point.

2. Light fitting according to claim wherein, the auxiliary reflector is arranged at least in its upper region, at an outward spacing from the main reflector.

3. Light fitting according to claim 1, wherein, the auxiliary reflector is formed by means of at least one of an external thickening and an adjoint piece of a peripheral wall of the main reflector, said thickening or adjoint piece is coated on its outside with a reflection layer which forms a reflection surface on the outside of the main reflector.

4. Light fitting according to claim 3, wherein, said outer surface of the thickening or the reflection surface is, in a section through said main axis, convexly formed.

5. Light fitting according to claim 3, wherein, said reflection surface of the thickening extends in a circumferential which is transverse to said main axis, parallel to the remaining peripheral surface of said peripheral wall of said main reflector (5).

6. Light fitting according to claim 3, wherein, the outer surface of said thickening is convexly formed.

7. Light fitting according to claim 3, wherein, thickening has a lens shaped cross-sectional form.

8. Light fitting according to claim 3, wherein said peripheral wall of the main reflector extends in one of a straight manner and a curved manner.

9. Light fitting according to claim 1, wherein, the reflection layer on the auxiliary reflector comprises a plurality of reflection strip surfaces which extend along a lateral periphery of the main reflector, at least some of said strips each enclosing a respective different angle with said main axis, which angles are closed in a direction of propagation of said lamp.

10. Light fitting according to claim 1, wherein, said reflection layer is a metallic layer.

11. Light fitting according to claim 1, wherein said reflection layer comprises at least in part, one of aluminum and chrome.

12. Light fitting according to claim 1, wherein, said reflection layer is formed by one of evaporation and chromizing.

13. Light fitting according to claim 1, wherein, there is arranged on at least one of the reflection surface of the auxiliary reflector and on one side of the main reflector a structure which causes light scattering over a small range of angles.

14. A light fitting comprising:

a lamp;

a main reflector containing said lamp and being formed about a main axis to cause a narrow light bundle from said lamp to be radiated in a first direction from said main reflector;

a portion of said main reflector being made of transparent material which is coated on an outer surface thereof with a reflection layer;

said outer surface of said portion being not parallel to a corresponding inner surface thereof in a section thereof through said main axis; and the outside of said portion having a light scattering structure, said light scattering structure being arranged and configured to scatter light incident from said lamp in a second direction different from said first direction.

15. Light fitting according to claim 14, wherein, said reflection layer is a metallic layer.

16. Light fitting according to claim 15, wherein, said reflection layer comprises at least in part, one of aluminum and chrome.

17. Light fitting according to claim 14, wherein, said reflection layer is formed by one of evaporation and chromizing.

18. Light fitting according to claim 14, wherein, there is arranged on the reflection surface of the main reflector a structure which causes light scattering over a small range of angles.

19. Light fitting according to claim 13 wherein said structure is provided with facetted surfaces.

20. Light fitting according to claim 18, wherein said structure is provided with facetted surfaces.

* * * * *